US009353681B2

(12) United States Patent
Daouk

(10) Patent No.: US 9,353,681 B2
(45) Date of Patent: May 31, 2016

(54) INTERNAL COMBUSTION ENGINE

(71) Applicant: Antar Daouk, Paris (FR)

(72) Inventor: Antar Daouk, Paris (FR)

( * ) Notice: Subject to any disclaimer, the term of this patent is extended or adjusted under 35 U.S.C. 154(b) by 0 days.

(21) Appl. No.: 14/160,312

(22) Filed: Jan. 21, 2014

(65) Prior Publication Data

US 2014/0130780 A1 May 15, 2014

Related U.S. Application Data

(63) Continuation of application No. 12/736,182, filed as application No. PCT/FR2009/050440 on Mar. 17, 2009, now Pat. No. 8,640,659.

(30) Foreign Application Priority Data

Mar. 17, 2008 (FR) ..... 08 01436

(51) Int. Cl.

| | |
|---|---|
| ***F02B 75/28*** | (2006.01) |
| ***F01B 1/01*** | (2006.01) |
| ***F01B 3/04*** | (2006.01) |
| ***F01B 9/06*** | (2006.01) |

(Continued)

(52) U.S. Cl.

CPC . *F02B 75/28* (2013.01); *F01B 1/01* (2013.01); *F01B 3/04* (2013.01); *F01B 7/02* (2013.01); *F01B 9/06* (2013.01); *F01L 1/30* (2013.01); *F01L 11/02* (2013.01); *F02B 75/282* (2013.01)

(58) Field of Classification Search

CPC .. F02B 75/28; F02B 2075/025; F02B 63/041; F02B 25/08; F02B 75/32; F02B 2075/027; F02B 2730/03

USPC ..... 123/56.1, 56.2, 51 R, 51 BC, 52.1, 52.2, 123/52.3

See application file for complete search history.

(56) References Cited

U.S. PATENT DOCUMENTS

| | | | |
|---|---|---|---|
| 1,372,559 | A | 3/1921 | Scheibler |
| 1,745,821 | A | 2/1930 | Von Gribojedoff |

(Continued)

FOREIGN PATENT DOCUMENTS

| | | |
|---|---|---|
| GB | 1346902 | 2/1974 |

OTHER PUBLICATIONS

International Search Report mailed by the International Searching Authority (ISA/EP) on Aug. 10, 2009 in connection with PCT International Application No. PCT/FR2009/050440, filed Mar. 17, 2009.

(Continued)

*Primary Examiner* — Stephen K Cronin
*Assistant Examiner* — Long T Tran
(74) *Attorney, Agent, or Firm* — John P. White; Cooper & Dunham LLP

(57) ABSTRACT

The invention relates to an engine (1) including: —a chamber (3) designed to accommodate a working fluid, —a first piston (4) defining the volume of said chamber (3), —a first passage (5) located in said first piston (4) to supply the chamber (3) with working fluid and/or to discharge from the chamber (3) the burned fluid resulting from the combustion of the working fluid, —a first valve (6) mounted on the first piston (4) to monitor the opening and closing of said first passage (5), —an output shaft (8) that engages with the first piston (4) to convert the motion of the first piston (4) into rotational motion of the output shaft (8), characterized in that the output shaft (8) and the first valve (6) engage to convert the motion of output shaft (8) into motion of the first valve (6).

18 Claims, 5 Drawing Sheets

(51) Int. Cl.

| | |
|---|---|
| ***F01L 1/30*** | (2006.01) |
| ***F01L 11/02*** | (2006.01) |
| ***F01B 7/02*** | (2006.01) |

(56) References Cited

U.S. PATENT DOCUMENTS

| | | | | |
|---|---|---|---|---|
| 2,228,184 | A * | 1/1941 | Strite | 123/238 |
| 2,331,165 | A * | 10/1943 | Bird | 123/51 BC |
| 2,473,936 | A * | 6/1949 | Burrough | 123/45 R |
| 4,090,478 | A * | 5/1978 | Trimble et al. | 123/56.9 |
| 4,366,784 | A * | 1/1983 | Paul | 123/45 A |
| 6,945,202 | B2 * | 9/2005 | Kaneko et al. | 123/46 R |
| 7,434,549 | B2 * | 10/2008 | Tse | 123/51 R |
| 8,091,519 | B2 * | 1/2012 | Bennion | 123/51 R |
| 2005/0081805 | A1 * | 4/2005 | Novotny | 123/51 R |
| 2006/0196456 | A1 | 9/2006 | Hallenbeck | |
| 2007/0261677 | A1 * | 11/2007 | Bennion | 123/51 R |
| 2008/0105224 | A1 * | 5/2008 | Kubes et al. | 123/56.1 |
| 2009/0250020 | A1 * | 10/2009 | McKaig et al. | 123/56.2 |
| 2010/0282219 | A1 * | 11/2010 | Alonso | 123/51 AA |
| 2011/0036330 | A1 | 2/2011 | Daouk | |

OTHER PUBLICATIONS

Written Opinion of the International Searching Authority mailed by the International Searching Authority (ISA/EP) on Aug. 10, 2009 in connection with PCT International Application No. PCT/FR2009/050440, filed Mar. 17, 2009.

International Preliminary Report on Patentability (Chapter I of the Patent Cooperation Treaty), including the Written Opinion of the International Searching Authority, issued by the International Bureau of WIPO on Nov. 2, 2010 in connection with PCT International Application No. PCT/FR2009/050440, filed Mar. 17, 2009.

Office Action issued Oct. 1, 2012 in connection with U.S. Appl. No. 12/736,182, filed Nov. 2, 2010.

Response to Office Action issued Oct. 1, 2012, filed Apr. 1, 2013, in connection with U.S. Appl. No. 12/736,182, filed Nov. 2, 2010.

Office Action issued May 16, 2013 in connection with U.S. Appl. No. 12/736,182, filed Nov. 2, 2010.

Response to Office Action issued May 16, 2013, filed Sep. 16, 2013, in connection with U.S. Appl. No. 12/736,182, filed Nov. 2, 2010.

Notice of Allowance issued Sep. 27, 2013 in connection with U.S. Appl. No. 12/736,182, filed Nov. 2, 2010.

* cited by examiner

INTERNAL COMBUSTION ENGINE

TECHNICAL FIELD

The present invention relates to the general technical field of engines, and in particular to internal combustion engines, which convert the thermal energy obtained by combustion, inside the engine itself, of a working fluid into mechanical energy that can be used, for example, to propel vehicles (such as automobiles, motorcycles, aircraft or ships), to drive machines (industrial or agricultural machinery) or to deliver mechanical energy to energy conversion devices of the electric power generator type.

The invention relates more precisely to an internal combustion engine comprising, on the one hand, a chamber designed to receive a working fluid intended to undergo combustion within said chamber and, on the other hand, a first piston that contributes to delimiting the volume of said chamber.

PRIOR ART

Internal combustion engines have been known for a long time and are widely used, since they are fitted into the very great majority of automobiles, even though only this type of motor-driven vehicle is mentioned.

The internal combustion engines most widely used are "four-stroke" engines which undergo a thermodynamic cycle corresponding substantially to the theoretical thermodynamic cycle referred to as the "Beau de Rochas cycle", well known in the field.

The architecture of these known four-stroke engines is generally based on the use of a cylinder which is closed in its upper part by a cylinder head.

The cylinder and the cylinder head together form a combustion chamber, the volume of which is regulated by the travel of a piston sliding in the cylinder with a reciprocating motion imparted by the pressure variations resulting from the combustion cycles carried out in the combustion chamber. The piston is itself connected to a crankshaft via a connecting rod in order to convert the rectilinear translational motion of the piston into rotational movement of the crankshaft. The cylinder head is intended to accommodate intake and exhaust valves which enable the combustible fluid (an air/fuel gas mixture) to be taken into the chamber and to enable the burnt gases resulting from the rapid combustion (or deflagration) of said fluid to be discharged out of the chamber, respectively. The motion of the valves relative to the cylinder head is controlled synchronously by one or more camshafts driven by the crankshaft, for example with the aid of a chain or gear system.

This known engine architecture is generally satisfactory, but it nevertheless has some serious drawbacks.

Firstly, the presence of a cylinder head fastened to the cylinder is likely to entail reliability problems, in particular at the cylinder head gasket interposed between the cylinder and the cylinder head. The use of a cylinder head and the corresponding gasket necessarily limits the compression ratio of the engine, since a high or very high compression ratio could of course damage the cylinder head gasket. Moreover, these known engines employ a relatively heavy and complex, mechanical and kinematic, chain for off-axis load transfer between the crankshaft, the camshaft (which is generally offset) and the valves. This of course constitutes a potential source of failure and loss of energy efficiency, and goes counter to both increased reliability and manufacturing cost reduction.

In general, these known engines employ a large number of moving parts, corresponding to a high moving mass, liable here again to cause efficiency and reliability problems. Moreover, the architecture of these known engines is relatively constricting from the point of view of intake and exhaust cross sections, which are limited to relatively small values because of the constraints on fitting the valves into the cylinder head. Finally, these known engines also prove to be relatively heavy and bulky, so that fitting them into an automobile, particularly an automobile of the passenger car type, may prove to be problematic.

SUMMARY OF THE INVENTION

One object of the invention is consequently to provide remedies to the various drawbacks mentioned above and to provide a novel engine having an architecture which is particularly simple, efficient and reliable.

Another object of the invention is to provide a novel engine which employs a minimal number of moving parts, which is particularly reliable and which has small dimensions, in particular in the height and width directions.

Another object of the invention is to provide a novel engine employing a mechanical link between the pistons and the output shaft, which, is not only particularly simple, efficient and reliable but also allows the performance of the engine to be easily and rapidly adjusted.

Another object of the invention is to provide a novel engine employing a minimal moving mass and capable of having large intake and/or exhaust cross sections.

Another object of the invention is to provide a novel engine which is particularly compact and avoids the use of off-axis load transfers and offset transmission parts.

Another object of the invention is to provide a novel engine capable of performing the intake stroke and the exhaust stroke particularly efficiently.

Another object of the invention is to provide a novel engine that employs a minimum number of different parts.

The objects assigned to the invention are achieved by means of an internal combustion engine comprising:

- a chamber designed to receive a working fluid intended to undergo combustion within said chamber;
- a first piston, which contributes to delimiting the volume of said chamber;
- a first passageway provided through said first piston in order to bring the inside of the chamber into communication with the outside, said first passageway being designed to supply the chamber with working fluid and/or to discharge, out of the chamber, the burnt fluid resulting from the combustion of the working fluid;
- a first valve mounted on the first piston in order to control the opening and closing of said first passageway; and
- an output shaft mounted coaxially with said first piston, the output shaft and the first piston cooperating so as to convert the motion of the first piston into rotational motion of the output shaft, characterized in that the output shaft and the first valve cooperate to convert the rotational motion of the output shaft into motion of the first valve relative to the first piston.

BRIEF DESCRIPTION OF THE DRAWINGS

Other objects and advantages of the invention will be understood in greater detail on reading the following description, with reference to the appended drawings, given purely by way of nonlimiting illustration, in which.

BEST WAY OF IMPLEMENTING THE INVENTION

Figure 1:
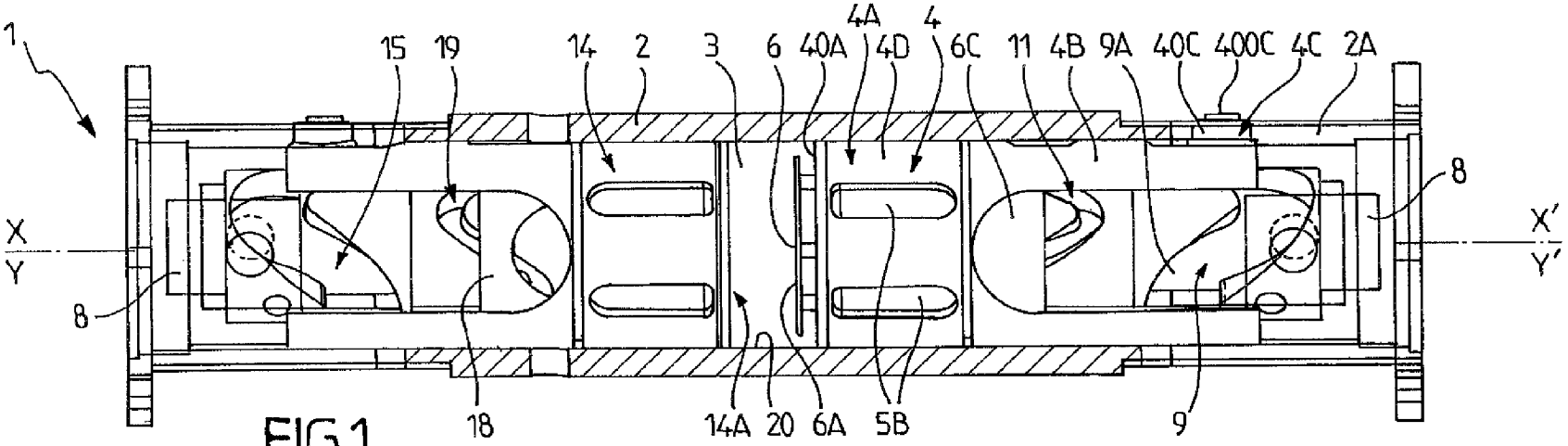
FIG. 1 illustrates, in a partial cross-sectional side view, an example of a four-stroke engine according to the invention.
Figure 2:
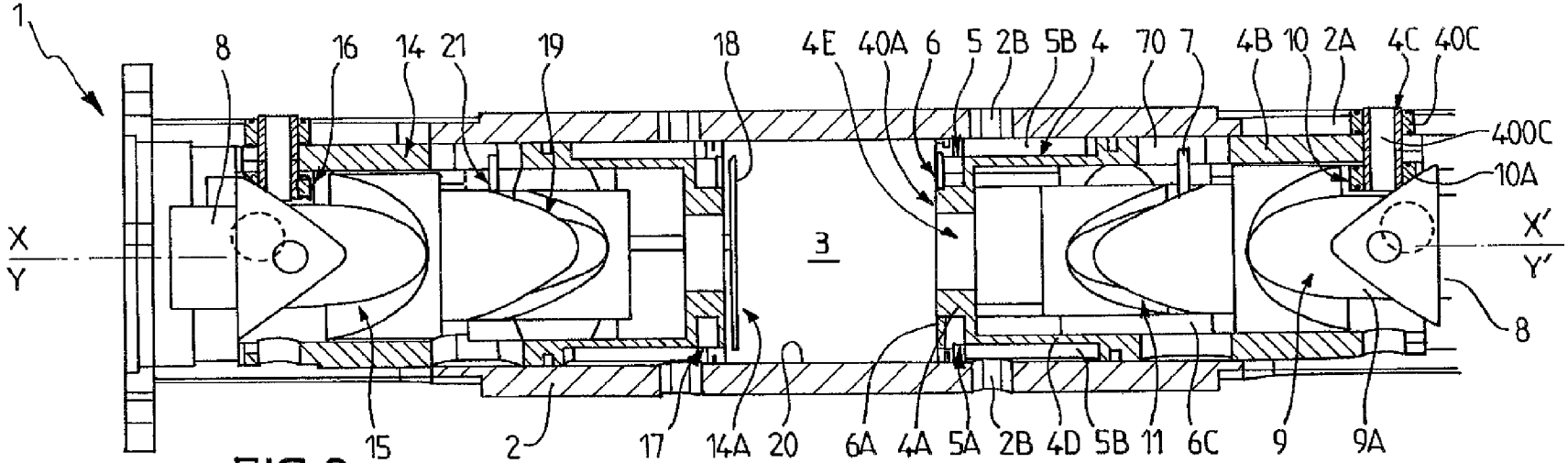
FIG. 2 illustrates, in another partial cross-sectional side view, the engine of FIG. 1.

The invention relates to an engine, that is to say a device capable of delivering mechanical work that can be used especially to propel a vehicle, for example an automobile, a motorcycle, an aircraft or a ship, or to operate a machine (a machine tool, civil engineering machinery, agricultural machinery, a pump, or a compressor) or an energy conversion device, such as a generator. The engine 1 according to the invention is an internal combustion engine, that is to say an engine capable of producing mechanical energy from the combustion within it of a working fluid containing a fuel, for example a hydrocarbon-based fuel such as gasoline. In a manner known per se, the engine 1 according to the invention comprises a chamber 3, forming a combustion chamber and designed for this purpose to receive a working fluid intended to undergo combustion within said chamber 3. The working fluid is therefore a combustible fluid and is preferably formed from a gas consisting of a mixture of air and vaporized fuel. This gas is intended to undergo rapid combustion, and more precisely an explosion (or even more precisely a deflagration), within the chamber 3. As envisaged above, the fuel may consist of a petroleum derivative, it being understood that the invention is absolutely not limited to a specific working fluid. To produce the chamber 3, the engine 1 preferably comprises a cylinder 2 which is, for example, as illustrated in the figures, in the form of a hollow, advantageously straight, tube with a longitudinal extension axis X-X'. Advantageously, as illustrated in the figures, the cylinder 2 has an approximately circular cross section. However, it is quite conceivable for the cylinder 2 to have a noncircular cross section, for example a polygonal cross section, without in any way departing from the scope of the invention. In the embodiment illustrated in the figures, the internal wall 20 of the cylinder 2 contributes to delimiting the chamber 3. To withstand the thermal and mechanical stresses resulting from the combustion of the working fluid within the chamber 3, the cylinder 2 is preferably made of a mechanically strong and heat-resistant material, such as for example a metallic material of the cast iron or aluminum alloy type.

The engine 1 according to the invention furthermore comprises at least a first piston 4 which contributes to defining the volume of the chamber 3. In the example illustrated in the figures, the first piston 4 is designed to slide in the cylinder 2 so as to perform a reciprocating motion (i.e. a to-and-fro motion) under the effect of the pressure variation within the chamber 3, said pressure variation being generated, as is well known as such, by the working fluid combustion cycles within the chamber 3. Thus, the first piston 4 is inserted into the cylinder 2 and fitted hermetically against the internal wall 20 of the cylinder 2 so as to be able to slide within the cylinder 2 along the X-X' axis, while still permanently remaining in sealing contact with the internal wall 20 of said cylinder 2. Sealing contact with the first piston 4 and with the internal wall 20 of the cylinder 2 may be achieved by any means known to a person skilled in the art, by adopting and adapting for example the well-known proven technical solutions employed in the prior art. The first piston 4 advantageously has a head 4A which contributes to defining the chamber 3. The head 4A preferably has a cross section complementary to the internal cross section of the cylinder 2, this cross section preferably being a circular cross section as in the examples illustrated in the figures. The first piston 4 furthermore includes a skirt 4B that extends peripherally from the head 4A. Advantageously, the first piston 4 has a longitudinal axis of extension Y-Y', which corresponds to the axis of symmetry of the cross section of the head 4A of said piston. The longitudinal axis Y-Y' of the first piston 4 is advantageously coincident with the axis of extension X-X' of the cylinder 2 when the first piston 4 is installed in the functional position inside the cylinder 2, as illustrated in FIGS. 1 to 10. According to the preferred embodiment illustrated in the figures, the first piston 4 is designed to slide in the cylinder 2 so as to perform a pure axial translational motion, that is to say said first piston 4 is guided relative to the cylinder 2 so as to be able to move only in longitudinal translation parallel to the X-X' axis, with no rotation of the first piston 4 about itself. In other words, the first piston 4 is in this case mechanically linked to the cylinder 2 by a guide rail link. Such axial guiding of the first piston 4 in pure translation in the cylinder 2 not only alleviates the problems of vibration and premature wear of the piston against the liner that are encountered in the engines of the prior art, but also the problems of loss of force that are encountered in these same engines. Said problems essentially stem from the fact that, in the prior art, the pistons are not guided directly in the cylinder but indirectly by connecting rods that work in an offset manner during the motion of the piston under load. Of course, there are many technical options, well known to those skilled in the art, for producing such a guide rail link between the first piston 4 and the cylinder 2. In the embodiment illustrated in the figures, this guide rail link, which allows the first piston 4 to slide in the cylinder 2 so as to perform a substantially pure rectilinear translational motion, is produced by the cooperation between at least one slide 4C mounted on the first piston 4 and a corresponding guide rail 2A provided in the cylinder 2 and extending approximately parallel to the longitudinal extension axis X-X' of said cylinder 2. Preferably, to ensure balanced guiding of the first piston 4 relative to the cylinder 2, the first piston 4 is provided with two slides placed in diametrically opposed positions on the piston with respect to the axis of symmetry Y-Y' of said piston. To improve the slide/guide rail contact, especially to limit the rubbing that impairs the efficiency of the engine, each slide advantageously includes a roller 40C rotatably mounted on a pin 400C which is itself mounted in a hole 40B provided through the skirt 4B, so that said pin 400C extends approximately radially with respect to the extension axis X-X' of the piston 4. For the sake of clarity of the figures, the second slide has not been shown in the figures, in which only the mounting hole 41B, provided in the skirt 4B, for mounting this second slide is visible. Each roller 40C is designed to roll in the corresponding guide rail 2A, which advantageously consists, as illustrated in the figures, of a rectilinear groove provided in the internal wall 20 of the cylinder 2, on the surface of said internal wall 20, facing the corresponding roller. However, the invention is absolutely not limited to the use of a first piston 4 mounted via a guide rail link in the cylinder 2. For example, it is quite conceivable, without in any way departing from the scope of the invention, for the first piston 4, during its reciprocating motion, to rotate about itself, i.e. about its axis Y-Y', in such a way that the motion of the first piston 4 in the cylinder 2 is in this case not a pure axial translational motion but a helicoidal translational motion.

In accordance with the invention, the engine 1 comprises a first passageway 5 provided through said first piston 4 in order to bring the inside of the chamber 3 into communication with the outside, said first passageway 5 being designed to supply the chamber 3 with working fluid and/or to discharge, from the chamber, the burnt fluid resulting from the combustion of the working fluid in the chamber 3. The first passageway 5 thus makes it possible for the fluid to pass directly through the first piston 4 itself, from the outside into the chamber 3 and/or from the chamber 3 to the outside. The invention is therefore based especially on the idea of providing the intake and/or the exhaust through a passageway provided in the piston itself, and not in a cylinder head attached to the cylinder, as in the prior art. The invention thus makes it possible to dispense with an attached cylinder head, thereby simplifying the engine and contributing to increasing the reliability thereof while reducing its manufacturing costs. This arrangement also increases the efficiency by the possibility of operating with very high compression ratios, owing to the absence of an attached cylinder head and the corresponding gasket. However, the use of an attached cylinder head is not absolutely excluded and it is quite conceivable for an engine according to the invention to include such a cylinder head, even though this does not correspond to a preferred embodiment.

In the example illustrated in the figures, the head 4A of the first piston 4 has a front face 40A which constitutes the top of the head 4 and is perpendicular to the Y-Y' axis. The front face 40A forms directly a wall of the chamber 3, and more precisely a movable wall that moves in the cylinder 2 under the effect of the motion of the first piston 4. The first passageway 5 is advantageously designed to allow fluid to be transferred through this front face 40A which contributes to delimiting the chamber 3. In the example illustrated in the figures, the head of the piston 4A has an approximately cylindrical shape with an annular side wall 4D that extends peripherally from the front face 40A. The front face 40A also has a circular cavity 400A in the form of a ring, said cavity having a bottom from which a circular lateral rim rises. In this exemplary embodiment, the first passageway 5 is formed by a plurality of holes 5A uniformly distributed angularly in the circular rim of the cavity and opening into corresponding slots 5B provided in the surface of the side wall 4D of the head 4A. Each slot 5B is itself preferably designed so as, at the opportune moment, to be opposite a corresponding hole 2B provided through the cylinder 2, and more precisely through the entire thickness of the tubular side wall of said cylinder 2. The hole 2B itself communicates with a fuel intake component (carburetor, injector or the like) and/or with the exhaust system, depending on whether the first passageway 5 is used for the intake and/or for the exhaust.

The combination of the hole 5A and its corresponding slot 5B with the complementary hole 2B thus constitutes a sealed duct allowing fresh gas to be taken in and/or burnt gas to be exhausted.

Figure 11:
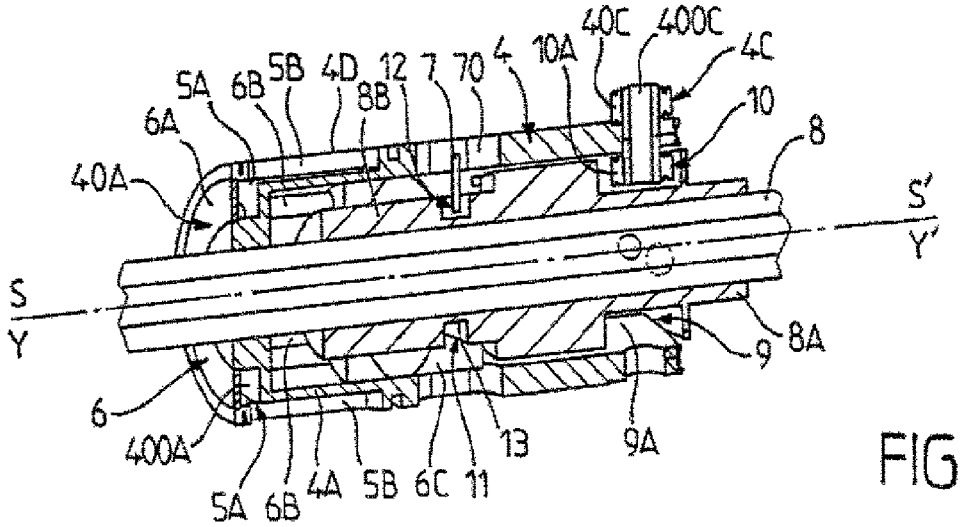
FIG. 11 illustrates, in a cross-sectional side view, the mechanical link between the output shaft and a piston in the engine of the previous figures.
Figure 16:
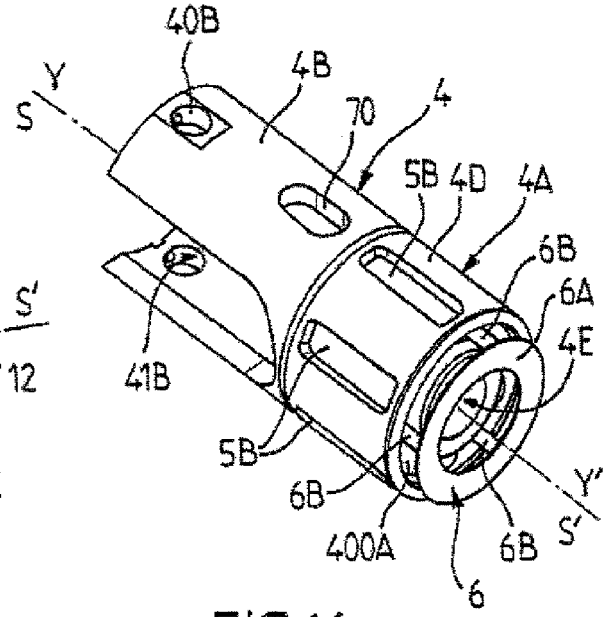
FIG. 16 illustrates, in a perspective view, a unitary subassembly resulting from fitting the valve of FIG. 15 on the pistons of FIGS. 13 and 14.

As illustrated in the figures, the engine 1 comprises a first valve 6 designed to control the opening and closing of the first passageway 5. In other words, the first valve 6 interacts with the first passageway 5 so as to allow the inside of the chamber 3 to communicate with the outside via the first passageway 5, or on the contrary to close off the first passageway 5 so as to prevent the inside of the chamber 3 communicating with the outside via the first passageway 5. The first valve 6 could for example be mounted on the cylinder 2 so as to cooperate directly with the holes 2B provided in said cylinder 2. However, it is much more advantageous, as in the embodiment illustrated in the figures, for the first valve 6 to be mounted on the first piston 4 in order to open and close the first passageway 5. Mounting the first valve 6 directly on the first piston 4 makes it possible to take advantage of a first passageway 5 with a large useful cross section, this being beneficial for intake or exhaust efficiency, without in any way complicating or burdening the architecture of the engine, since placing the valve on the piston has the advantage that all the holes 5A making up the first passageway 5 can be opened/closed simultaneously. It is therefore particularly advantageous, as illustrated in the figures, to provide a unitary subassembly formed by the first piston 4 and the first valve 6, said valve being mounted on the first piston 4. Preferably, the first valve 6 is slidably mounted on the first piston 4, so as to slide between, on the one hand, at least a closed position (illustrated especially in FIG. 11) in which it hermetically seals off the first passageway 5, and more precisely the holes 5A, and, on the other hand, at least an open position (illustrated especially in FIG. 16) in which it frees the first passageway 5 so that it thereby allows communication between the chamber 3 and the outside. Advantageously, the first valve 6 has an axis of symmetry S-S' and is mounted so that it can slide axially on the piston 4, that is to say it is able to slide relative to said first piston 4 substantially parallel to the Y-Y' axis of said piston, the Y-Y' and S-S' axes being coincident. The mounting of the first valve 6 so as to slide axially relative to the first piston 4 may be achieved by any means known to a person skilled in the art. Preferably, the first valve 6 includes at least one guide pin 7 that extends approximately radially with respect to the S-S' axis, and preferably two guide pins in diametrically opposed positions relative to the S-S' axis. Advantageously, each guide pin 7 is designed to move translationally in a complementary oblong guide slot 70 provided in the skirt 4B of the piston 4. More precisely, in the example illustrated in the figures, the first valve 6 has a seal 6A that takes the form of an approximately flat circular ring intended to be inserted into the complementarily shaped cavity 400A provided in the front face 40A of the head 4A of the first piston 4. When the first valve 6 is in its closed position, the seal 6A is pressed against the bottom of the cavity for the holes 5A to be sealingly closed off. However, when the first valve 6 is in its open position, the seal 6A is away from the bottom of the cavity, thereby freeing the holes 5A and allowing fluid to flow therethrough. The seal 6A is advantageously fastened, by means of legs 6B (for example three legs uniformly distributed angularly), to a tubular valve skirt 6C on which each guide pin 7 is mounted.

Advantageously, the valve skirt 6C is designed to slide inside the skirt 48 of the first piston 4, against said piston skirt 4B, the legs 6B passing through the bottom of the cavity 400A via through-openings provided in said bottom. Said legs 68 slide, in the through-openings in question, tightly and sealingly so as to avoid any leakage via said through-openings.

As illustrated in the figures, the engine 1 comprises an output shaft 8 mounted coaxially with the first piston 4, the output shaft 8 and the first piston 4 cooperating to convert the motion of the first piston 4 into rotational motion of the output shaft 8. Preferably, the cooperation between the output shaft 8 and the first piston 4 is reciprocal, that is to say it enables the rotational motion of the output shaft 8 to be converted into the motion of the first piston 4, that is to say in this case into the reciprocating (to-and-fro) motion of said first piston 4. The output shaft 8 preferably is straight, extending along a longitudinal axis Z-Z' which is advantageously coincident with the X-X' axis of the cylinder 2 and also, in this case, coincident with the Y-Y' axis of the first piston 4 and the S-S' axis of the first valve 6. Preferably, the output shaft 8 passes through the first piston 4, that is to say said first piston 4 is fitted over the output shaft 8. For this purpose, the first piston 4 is provided with a central hole 4E through which the output shaft 8 passes, said shaft being tightly fitted into the hole 4E so as to allow the first piston 4 to slide along the output shaft 8 while still remaining in sealing contact with said output shaft 8 and thus prevent any communication between the inside of the chamber 3 and the outside via the interface between the output shaft 8 and the first piston 4. It should be noted that, for the sake of simplicity and clarity, a central portion of the output shaft 8, which passes through the chamber 3, has been omitted in FIGS. 1 and 2.

Preferably, the output shaft 8 and the first piston 4 cooperate directly to convert the motion of the first piston 4 into rotational motion of the output shaft 8, and vice-versa. For this purpose, the first piston 4 and the output shaft 8 are provided with complementary load transmission means designed to convert the reciprocating motion (pure axial translational motion in the example illustrated in the figures) of the first piston 4 into rotational motion, and more precisely into continuous rotational motion in only one rotation direction, of the output shaft 8. In other words, the complementary load transmission means with which the first piston 4 and the output shaft 8 are equipped enable the rectilinear reciprocating motion of the first piston 4 to be converted into rotation of the output shaft 8 about itself, i.e. about its Z-Z' axis. The embodiment of the engine 1 according to the invention illustrated in the figures therefore operates according to the following general principle:

- the pressure variations within the chamber 3, obtained by cycles of deflagration of a detonating mixture (of the vaporized fuel/air mixture type), induce a rectilinear reciprocating motion of the first piston 4; and
- the first piston 4 itself causes the output shaft 8 to rotate, this constituting the drive shaft intended to be connected to the object to be driven, for example connected to the wheels of an automobile.

Such a design avoids the use of off-axis load transfer along the various working axes, as in the prior art. In contrast such a design allows direct transmission of the action of the first piston 4 on the output shaft 8. In other words, the first piston 4 rotates the output shaft 8 directly, thereby making the engine 1 particularly compact, and thus able to be easily integrated into the body of a vehicle.

By its very nature, such a design also lowers the center of gravity of the vehicle because of the essentially longitudinal character of the engine 1, enabling said engine 1 to be positioned along the axis of symmetry of said vehicle. Thanks to the direct coaxial driving of the output shaft 8 via the first piston 4, the torsional stresses to which the output shaft 8 is subjected are greatly reduced compared with those imparted to crankshafts via the connecting rods in engines of the prior art.

Advantageously, the engine 1 comprises a first guide path 9 integral with the output shaft 8 and preferably formed (i.e. produced directly or attached) on the output shaft 8, on the surface thereof. Advantageously, the engine 1 also comprises a first guiding element 10 integral with the first piston, said first guiding element 10 being mounted so as to move along the first guide path 9, in order to convert the motion of the first piston 4 into rotational motion of the output shaft 8. Advantageously, as illustrated in the figures, the first guide path 9 has a substantially undulating shape, and even more preferably a substantially sinusoidal shape. More precisely, in the example illustrated in the figures, the first guide path 9 follows an annular profile around the longitudinal extension axis Z-Z' of the output shaft 8. Advantageously, the engine 1 comprises a first ring 8A mounted on the output shaft 8, said first ring 8A bearing said first guide path 9. The first ring 8A may thus consist of an annular part separate from the output shaft 8 and fitted onto the latter. In this case, the first ring 8A is mounted on the output shaft 8 so as to rotate (about the X-X' axis) as one with the output shaft 8. It is also quite conceivable for the first ring 8A to be made as one piece with the output shaft 8. Preferably, the first guide path 9 comprises a first groove 9A provided in the surface of the first ring 8A (i.e. that of the output shaft 8 when the ring 8A merges with the output shaft 8), whereas the first guiding element 10 comprises a first finger that protrudes from the first piston 4 and engages in said first groove 9A. Preferably, the first guiding element 10 comprises two fingers in diametrically opposed positions relative to the Y-Y' axis and engaging the same first groove 9A. To improve the contact between the first guiding element 10 and the first groove 9A, the first finger advantageously comprises a roller 10A rotatably mounted on a pin which is itself mounted in a hole provided through the skirt 4B, so that said pin extends approximately radially with respect to the extension axis X-X of the piston 4. Preferably, the pin in question corresponds to the pin 400C on which the roller 40C is mounted. In this particularly simple and reliable construction, the roller 10A is mounted on the pin 400C, inside the skirt 4B, in order to engage with the corresponding sinusoidal groove 9A, whereas the roller 40C is mounted on the same pin 400C, outside the skirt 4B, in order to engage with the corresponding rectilinear groove 2A.

As illustrated in the figures, the output shaft 8 and the first valve 6 cooperate to convert the rotational motion of the output shaft 8 into motion of the first valve 6 relative to the first piston 4. Thus, the position of the first valve 6 relative to the first piston 4, and therefore the opening and closing of the first passageway 5, are controlled directly by the output shaft 8 which interacts, preferably directly, with the first valve 6 in order to impart a motion on the latter, for example an axial translational reciprocating motion as in the embodiment illustrated in the figures. For this purpose, the engine 1 advantageously comprises a second guide path 11 integral with the output shaft 8 and preferably formed (i.e. produced directly or attached) on the output shaft 8, on the surface of the latter. Advantageously, the engine 1 also comprises a second guiding element 12 integral with the first valve 6, said second guiding element 12 being mounted so as to move along the second guide path 11, in order to convert the rotational motion of the output shaft 8 into motion of the first valve 6 relative to the first piston 4, and more particularly into rectilinear axial reciprocating (i.e. to-and-fro) motion. Advantageously, and as illustrated in the figures, the second guide path 11 has a substantially undulating shape and even more preferably a substantially sinusoidal shape. Preferably, the second guide path does not have a purely sinusoidal profile so as to allow, at the opportune moment, the intake and exhaust, as explained in greater detail below. For example, the profile of the second guide path 11 follows that of the first guide path 9 during the compression and expansion phases (when the valve 6 has to be closed), whereas during the intake and exhaust phases the profile of the second guide path 11 is offset relative to that of the first guide path 9 so as to allow the valve 6 to open and close at the right time.

Preferably, just like the first guide path 9, the second guide path 11 extends with an annular profile around the longitudinal extension axis Z-Z' of the output shaft 8. Advantageously, the engine 1 comprises a second ring 8B mounted on the output shaft 8, said second ring 8B bearing said second guide path 11. The second ring 8B may thus be made of an annular part separate from the output shaft 8 and fitted onto the latter. In this case, the second ring 8B is mounted on the output shaft 8 so that it rotates (about the X-X' axis) as one with the output shaft 8. It is also quite conceivable for the second ring 8B to be made as one piece with the output shaft 8.

Figure 12:
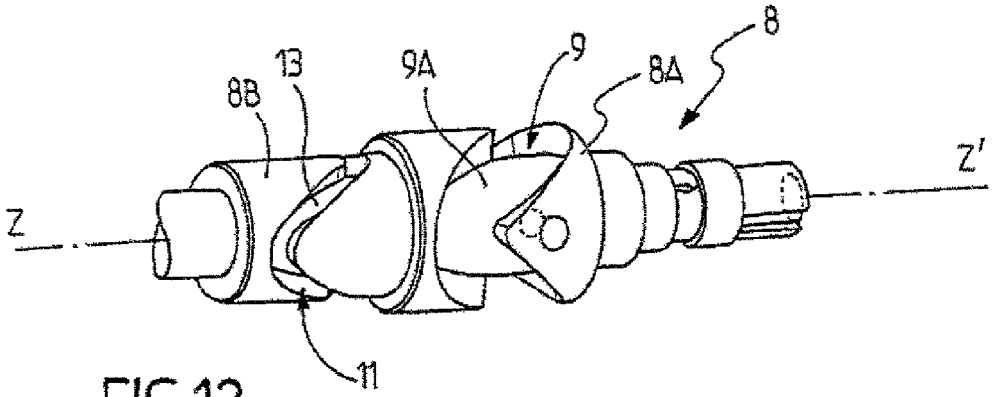
FIG. 12 illustrates, in a perspective view, a detail of the output shaft of the engine of the previous figures.
Figure 13:
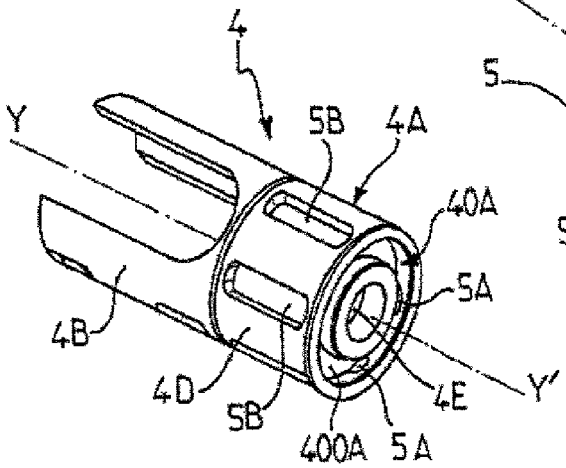
FIGS. 13 and 14 illustrate, in perspective views, a detail of the construction of a piston employed in the engine of the previous figures.
Figure 14:
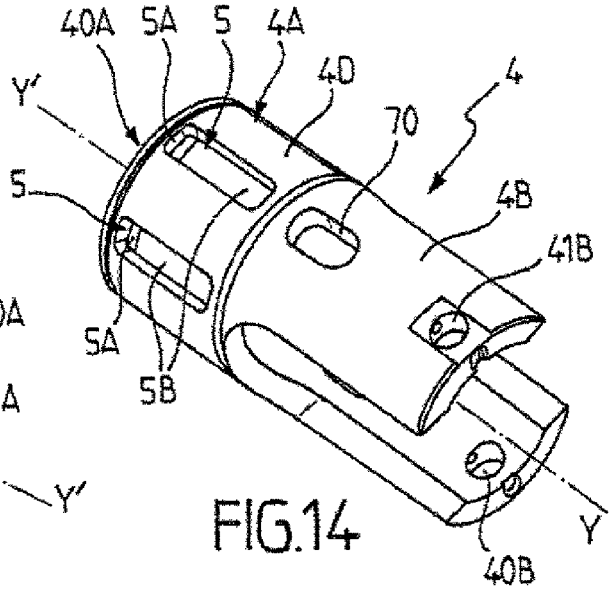
Figure 15:
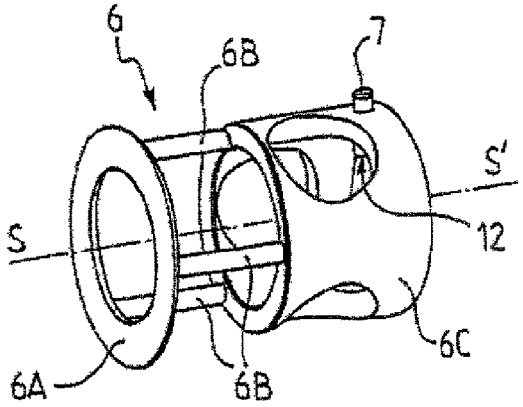
FIG. 15 illustrates, in a perspective view, a valve used in the engine of the previous figures and intended to be mounted on the piston shown in FIGS. 13 and 14.

Preferably, the first guide path 9 comprises a first groove 9A provided on the surface of the first ring 8A (i.e. that of the output shaft 8 when the ring 8A merges with the output shaft 8), whereas the first guiding element 10 comprises a first finger which protrudes from the first piston 4 and engages in said first groove 9A. In the preferred embodiment illustrated in the figures, the second guide path 11 comprises a second groove 13 made in the surface of the second ring 88 (i.e. that of the output shaft 8 when the ring 8B merges with the output shaft 8), whereas the second guiding element 12 comprises a second finger that protrudes from the first valve 6 and engages in said second groove 13. Thus, it is particularly advantageous to provide a mechanical coupling between the valve 6 and the output shaft 8 which is substantially similar, at least in its principle, to the mechanical coupling that exists between the first piston 4 and this same output shaft 8. Preferably, the second guiding element 12 is formed by a cylindrical rod that extends through the skirt 6C of the first valve 6, the first end of said rod, located outside said skirt 6C, forming the guide pin 7, whereas the second, opposite end, located inside said skirt 6C, forms the actual second guiding element, which extends substantially radially with respect to the S-S' axis. Preferably, the second guiding element 12 is formed by two cylindrical rods in diametrically opposed positions relative to the S-S' axis (only one of these rods is shown in the figures, for the sake of simplicity and clarity of the drawings). Advantageously, and as illustrated in FIG. 12, the first and second rings 8A, 8B are formed by one and the same part made as a single piece, which bears both the first guide path 9 and the second guide path 11. However, it is conceivable, in an alternative embodiment, for the first and second rings 8A, 8B to be formed by separate independent parts. In this case, it is for example advantageous for the first ring 8A to be fixedly (or even movably, that is to say translationally and/or rotationally) mounted on the output shaft 8 and for the second ring 8B to be movably mounted on the output shaft 8 and preferably to be capable of rotating, relative to the output shaft 8 and to the first ring 8A, about the X-X' axis. In this preferred embodiment, the angular position of the second ring 8B relative to the output shaft 8 may thus be advantageously adjusted, by any suitable means, thereby making it possible for example to adjust the intake according to the speed of the engine 1. Thus it suffices for the second ring 8B to be rotated slightly relative to the shaft 8 in order to act on the speed and/or the moment of opening of the first valve 6. It is also conceivable for the second ring 8B to be mounted so as to move translationally relative to the output shaft 8 in order to adjust the position of the first valve 6 according to the advance of the thermodynamic cycle of the engine 1.

Advantageously, the engine 1 according to the invention comprises a second piston 14 which also contributes to delimiting the volume of the chamber 3. Preferably, and as illustrated in the figures, the engine 1 thus comprises in this case a cylinder 2 within which the first and second pistons 4, 14 are mounted so as to slide axially. In this particularly advantageous embodiment, which is illustrated in the figures, the chamber 3 is preferably formed by the intervening space separating the first piston 4 from the second piston 14 in the cylinder 2. In other words, the chamber 3 corresponds in this case to the free space of variable volume located inside the cylinder 2 between the pistons 4, 14. Advantageously, as illustrated in the figures, the first and second pistons 4, 14 are mounted opposite each other within the cylinder 2, that is to say in such a way that their respective heads 4A, 14A face each other. The chamber 3 thus extends in the space bounded axially by the heads 4A, 14A of the first and second pistons 4, 14 and bounded radially by the internal wall 20 of the cylinder 2 that extends between said heads 4A, 14A of said pistons 4, 14. The chamber 3 therefore has a variable volume that depends on the relative position of the first and second pistons 4, 14.

Advantageously, the first piston 4 and the second piston 14 are designed to move so as to undergo opposed reciprocating motions, in such a way that said pistons 4, 14 approach and move away from each other substantially at the same time. In other words, the first piston 4 and the second piston 14 move symmetrically with respect to the mid-plane of the chamber 3 perpendicular to the X-X' axis. In the preferred embodiment illustrated in the figures, each piston 4, 14 is designed to move in the cylinder 2 individually, that is to say independently of the other piston. Preferably, the second piston 14 is identical to the first piston 4 and is also mounted in the engine 1 in an identical manner to said first piston 4. In this advantageous embodiment, which is illustrated in the figures, the output shaft 8 is therefore also mounted coaxially with the second piston 14, the output shaft 8 and the second piston 14 cooperating to convert the motion of the second piston 14 into rotational motion of the output shaft 8. For this purpose, the engine 1 preferably comprises a third guide path 15 integral with the output shaft 8 and preferably formed (i.e. produced directly or attached) on the output shaft 8, on the surface of the latter. Advantageously, the engine 1 further comprises a third guiding element 16 integral with the second piston 14, said third guiding element 16 being mounted so as to move along the third guide path 15 in order to convert the motion of the second piston 14 into rotational motion of the output shaft 8 in concert with the first piston 4. Preferably, the third guide path 15 has a substantially undulating shape which is advantageously symmetrical with the shape of the first guide path 9 with respect to the mid-plane of the chamber 3 perpendicular to the X-X' axis. Advantageously, the structures of the third guide path 15 and of the third guiding element 16 are identical to the structures of the first guide path 9 and of the first guiding element 10 respectively.

Advantageously, the engine 1 comprises a third ring mounted on the output shaft 8, said third ring bearing said third guide path 15. The third ring may thus consist of an annular part separate from the output shaft 8 and fitted onto the latter. In this case, the third ring is mounted on the output shaft 8 so as to rotate (about the X-X' axis) as one with the output shaft 8. It is also quite conceivable for the third ring to be made as one piece with the output shaft 8. Preferably, the third guide path 15 comprises a third groove provided in the surface of the first ring 8A (i.e. that of the output shaft 8 when the ring 8A merges with the output shaft 8), whereas the third guiding element 16 comprises a third finger with a roller, protruding from the second piston 14 and engaging in said third groove. In the end, in the example illustrated in the figures, the engine 1 has an overall symmetry with respect to the mid-plane of the chamber 3, that is to say the plane that passes through the center of the chamber 3 and is perpendicular to the longitudinal extension axis X-X' of the cylinder 2. It proves to be particularly beneficial to combine:

- a chamber 3 bounded by two pistons 4, 14 working in opposition; and
- the formation of a passageway 5 provided within and through one of said pistons for bringing the inside of the chamber 3 into communication with the outside.

This is because, when the first passageway 5 is open, that is to say when the chamber 3 is in communication with the outside via said first passageway 5, said reciprocating motions of the first piston 4 provide less effective compression and suction effects since the thrust or suction section of said piston 4, which corresponds to the front face 40A, is then not sealed (since the valve 6 is open).

By using a second piston 14 working in opposition with the first piston 4 it is possible to alleviate this compression and suction deficit by the second piston working simultaneously, thereby reinforcing the first piston 4 in the suction and compression phases.

Preferably, the engine 1 comprises a second passageway 17 provided through the second piston 14 in order to bring the inside of the chamber 3 into communication with the outside. Preferably, in the dual-piston architecture illustrated in the figures, the second passageway 17 provided in the second piston 14 is designed to supply the chamber 3 with the working fluid, that is to say with the fresh mixture intended to be burnt, whereas the first passageway 5 of the first piston 4 is designed to discharge, out of the chamber 3, the burnt fluid resulting from the combustion of the working fluid in the chamber 3. Thus, the intake is through the second piston 14 whereas the exhaust is through the first piston 4. Such a design proves to be particularly advantageous for producing an engine operating with a four-stroke cycle, as will be described in greater detail in what follows.

Moreover, an internal combustion engine 1 comprising:

- a chamber 3 designed to receive a working fluid intended to undergo combustion within said chamber 3;
- a first piston 4 and a second piston 14, both of which contribute to delimiting the volume of said chamber 3;
- a first passageway 5 provided through said first piston 4 in order to bring the inside of the chamber 3 into communication with the outside, said first passageway 5 being designed to discharge, out of the chamber 3, the burnt fluid resulting from the combustion of the working fluid; and
- a second passageway 17 provided through said second piston 14 in order to bring the inside of the chamber 3 into communication with the outside, said second passageway 17 being designed to supply the chamber 3 with the working fluid, constitutes as such an independent invention.

Of course, it is particularly advantageous to provide, as regards the second piston 14, technical measures identical to those employed on the first piston 4. This means that, in this example, the engine 1 comprises a second valve 18 identical to the first valve 6, said second valve 18 being mounted on the second piston 14 in order to control the opening and closing of the second passageway 17 provided through the second piston 14. Likewise, the output shaft 8 and the second valve 18 cooperate to convert the rotational motion of the output shaft 8 into motion of the second valve 18 relative to the second piston 14. For this purpose, the engine 1 comprises, on the one hand, a fourth guide path 19 integral with the output shaft and preferably formed on the output shaft 8 and, on the other hand, a fourth guiding element 21 integral with the second valve 18, said fourth guiding element 21 being mounted so as to move along the fourth guide path 19 in order to convert the rotational motion of the output shaft into motion of the second valve relative to the second piston. Advantageously, the fourth guide path 21 has a substantially undulating shape, and even more preferably a substantially sinusoidal shape. The structure of the second valve 18, of the second piston 14 and of the corresponding part of the shaft 8 that cooperates both with the second valve 18 and with the second piston 14 will not be described in greater detail since, as indicated in the foregoing, the engine 1 is advantageously symmetrical with respect to the mid-plane of the chamber 3.

The operation of the engine 1 illustrated in the figures will now be described in the context of a four-stroke cycle.

Figure 3:
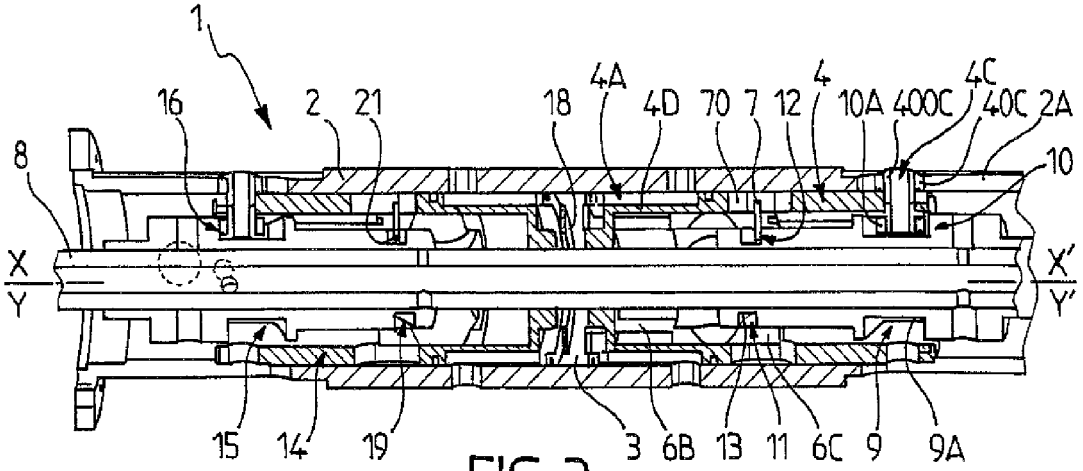
FIG. 3 illustrates, in a cross-sectional side view, the engine of FIGS. 1 and 2 during the implementation of the first (intake) stroke.
Figure 4:
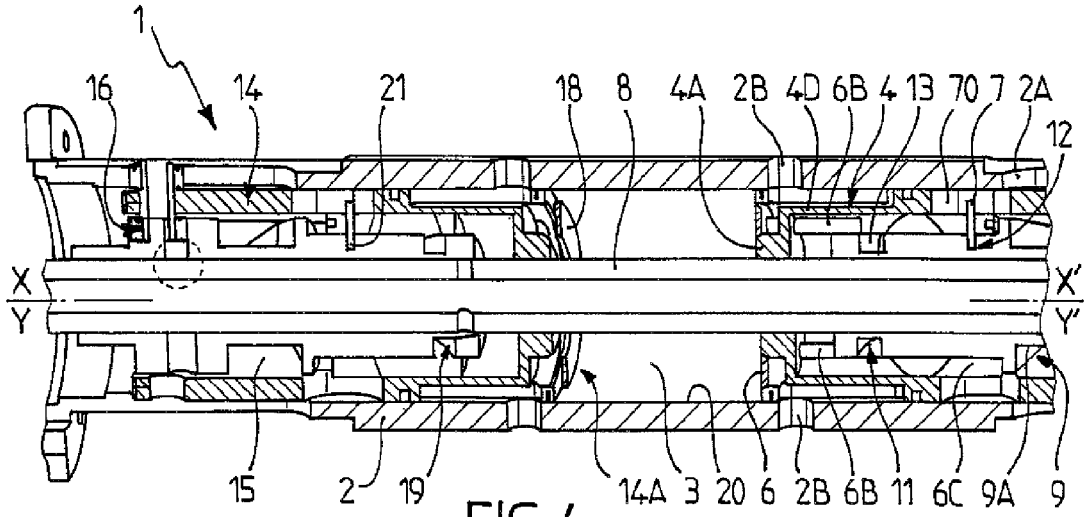
FIG. 4 illustrates, in a cross-sectional side view, the engine of the previous figures at the end of the first stroke.
Figure 5:
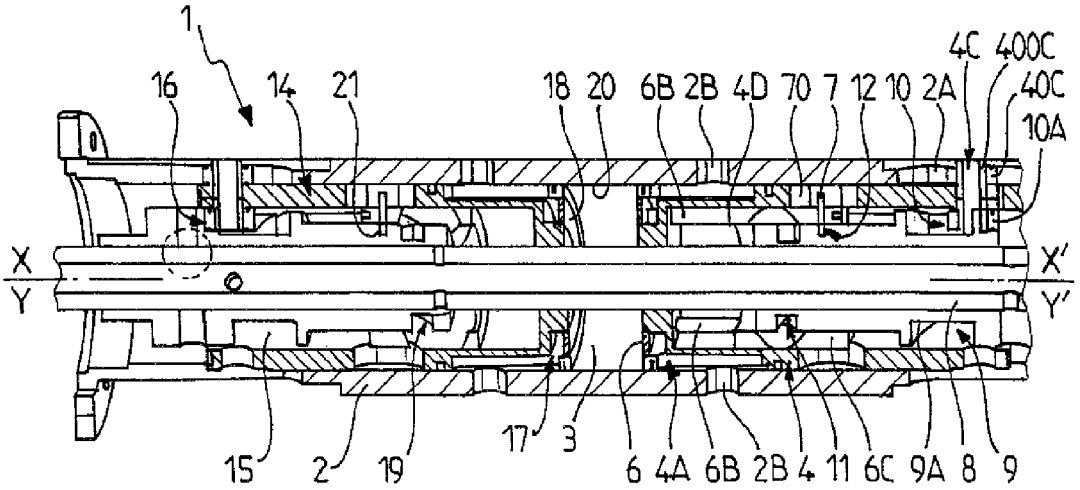
FIG. 5 illustrates, in a cross-sectional side view, the engine of the previous figures during the implementation of the second (compression) stroke.

The first stroke of the engine's operating cycle, which is illustrated in FIGS. 3 and 4, corresponds to the intake of the working fluid, which is preferably formed by a mixture of air and vaporized fuel, into the combustion chamber 3. For this purpose, the second valve 18 is in the open position, so as to admit, through the second piston 14 via the second passageway 17, the fresh working fluid coming from outside the cylinder 2.

During this first stroke, the first and second pistons 4, 14 move further apart, which creates a vacuum in the combustion chamber 3, thereby forcing the working fluid to be sucked in via the second passageway 17, the second valve 18 being opened to allow the working fluid to enter the combustion chamber 3. The first valve 6, with which the first piston 4 is equipped, is itself closed, thereby ensuring that there is excellent suction owing to the displacement of the first piston 4, this suction compensating for the weaker suction generated by the second piston 14, the valve 18 of which is open.

Once they have arrived at their positions furthest apart (illustrated in FIG. 4), the pistons 4, 14 move closer together, i.e. they approach each other (FIG. 5), so as to compress the working fluid contained in the chamber 3. During this coming-together movement of the pistons, which corresponds to the second stroke, the first and second valves 6, 18 are closed so as to compress the working fluid between the pistons 4, 14. The working fluid is thus highly compressed, causing it to heat up.

Figure 6:
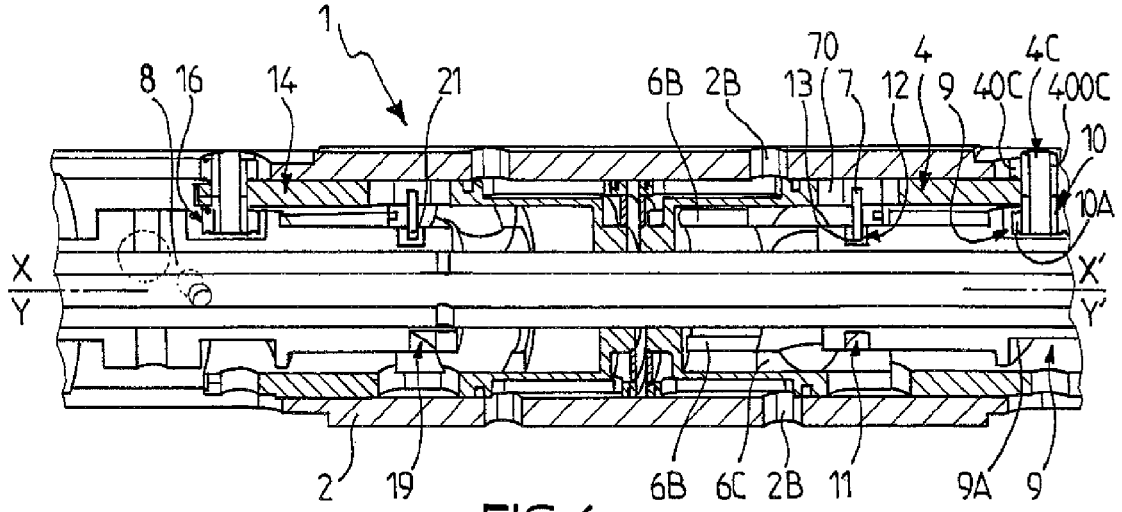
FIG. 6 illustrates, in a cross-sectional side view, the engine of the previous figures during the implementation of a first (explosion) phase of the third stroke.
Figure 7:
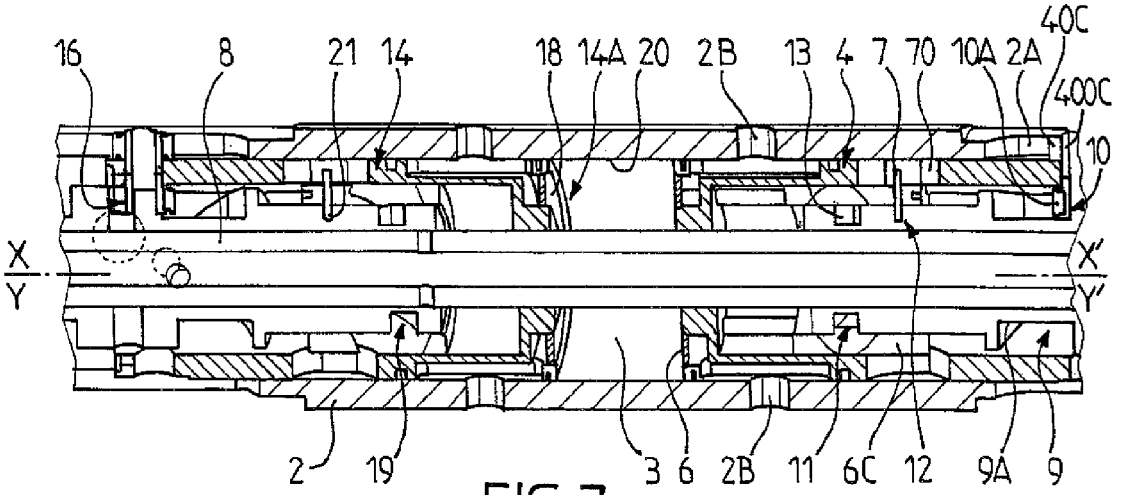
FIG. 7 illustrates, in a cross-sectional side view, the engine of the previous figures during the implementation of a second (expansion) phase of the third stroke.
Figure 8:
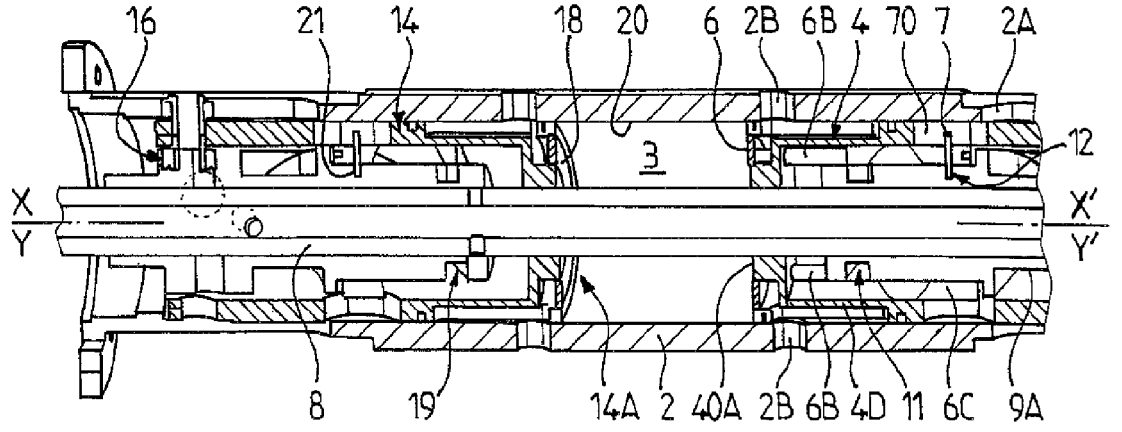
FIG. 8 illustrates, in a cross-sectional side view, the engine of the previous figures at the end of the expansion phase, when the pistons are in what is called a "bottom dead center" position.
Figure 9:
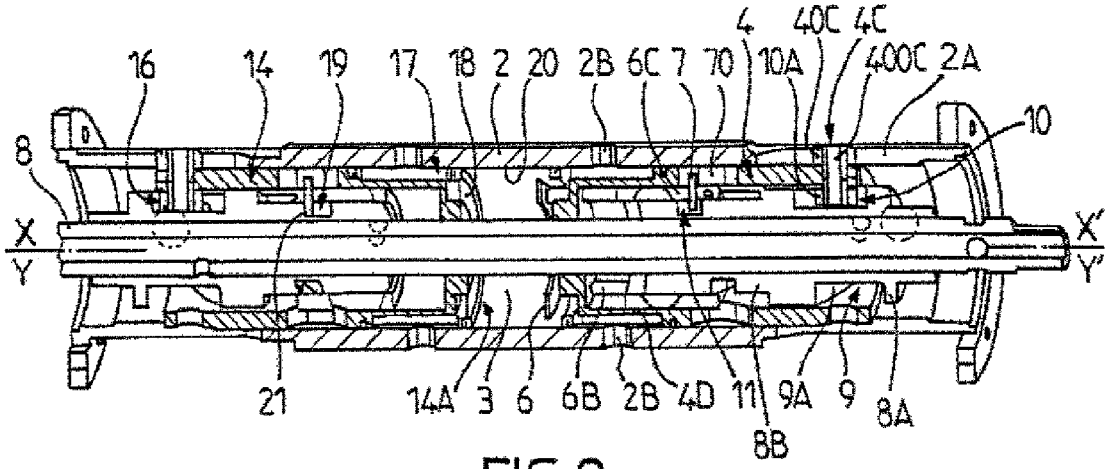
FIG. 9 illustrates, in a cross-sectional side view, the engine of the previous figures at the start of the fourth (exhaust) stroke.
Figure 10:
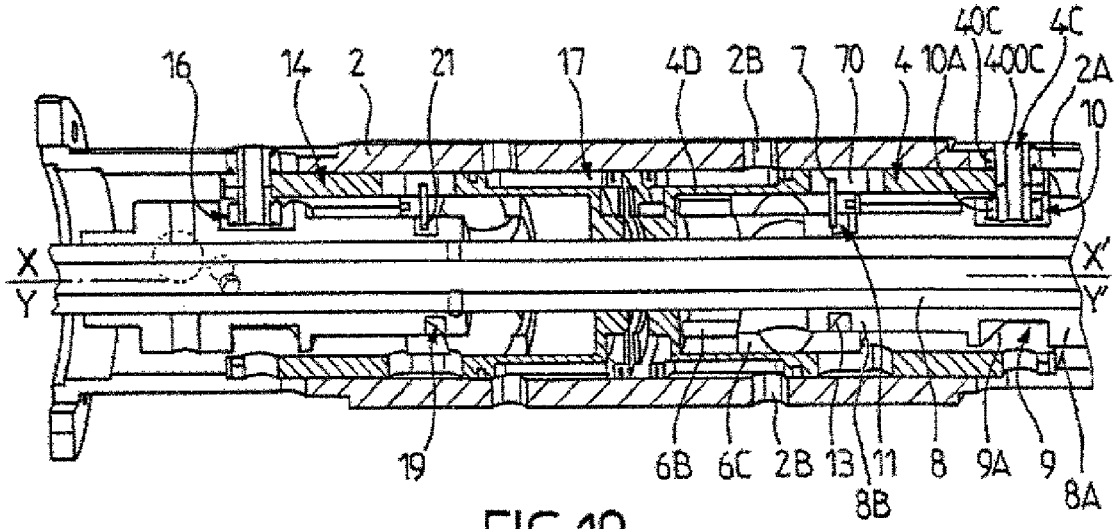
FIG. 10 illustrates, in a cross-sectional side view, the engine of the previous figures at the end of the exhaust stroke.

When the pistons 4, 14 reach their point closest together (the pistons are then in what is called the "top dead center" position), illustrated in FIG. 6, the working fluid, when compressed to the maximum, explodes through the ignition effect obtained by producing a spark generated by a spark plug (not shown) or through the effect of the compression ratio itself, which heats the working fluid such that it explodes spontaneously (in the case of a diesel engine).

This explosion phase produces an expansion of the gases constituting the working fluid. This expansion generates a high pressure in the chamber (for example between 40 and 100 bar) which is exerted on the pistons, the valves 6, 18 of which are closed, thereby causing the pistons 4, 14 to move apart.

This moving-apart of the pistons 4, 14 through the effect of the pressure resulting from the explosion in the chamber makes the output shaft 8 rotate. Thus, this explosion and expansion phase (corresponding to the third stroke) creates the thermal energy which is converted into mechanical energy to rotate the output shaft 8. The pistons 4, 14 then come closer together again, which creates a compression in the chamber 3.

At this moment, the first valve 6 of the first piston 4 is opened, thereby making it possible, through the compression effect produced by the pistons 4, 14 moving closer together for the burnt working fluid to be exhausted through the first passageway 5.

After this fourth stroke, the engine 1 is again in the configuration corresponding to the first stroke and is ready, once again, to start the four-stroke cycle described above.

The invention also relates as such to a vehicle, of the automobile kind, equipped with an engine 1 according to the invention.

The invention also relates, independently, to a piston 4 designed to form the first piston 4 of an engine 1 according to the invention.

Finally, the invention also relates to a valve designed to form the first valve 6 of an engine 1 according to the invention.

INDUSTRIAL APPLICABILITY

The invention is industrially applicable in the design, manufacture and use of engines.

The invention claimed is:

1. An internal combustion engine comprising:

a chamber designed to receive a working fluid intended to undergo combustion within said chamber;

a first piston and a second piston, both of which contribute to delimiting the volume of said chamber, the first piston and second piston being configured to perform opposing reciprocating movements in which the first piston and the second piston simultaneously move to approach each other and simultaneously move to withdraw from each other;

a first passageway provided through said first piston in order to bring the inside of the chamber into communication with the outside of the chamber, said first passageway being designed to discharge, out of the chamber, the burnt fluid resulting from the combustion of the working fluid; a second passageway provided through said second piston in order to bring the inside of the chamber into communication with the outside, said second passageway being designed to supply the chamber with the working fluid;

an output shaft mounted coaxially with the second piston, the output shaft and the second piston cooperating to convert the motion of the second piston into rotational motion of the output shaft; and a second valve mounted on the second piston to control the opening and closing of said second passageway;

wherein the output shaft and the second valve cooperate to convert the rotational motion of the output shaft into motion of the second valve relative to the second piston.

2. The engine of claim 1, further comprising a cylinder which is in the form of a hollow straight tube within which the first and second pistons are mounted so as to slide axially, said chamber being formed by the intervening space separating said pistons in the cylinder.

3. The engine of claim 2, wherein the first piston and the second piston work in opposition in the cylinder.

4. The engine of claim 3, wherein the first piston and the second piston are designed to move so as to undergo opposed reciprocating motions.

5. The engine of claim 4, further comprising an output shaft mounted coaxially with the first piston, the output shaft and the first piston cooperating to convert the motion of the first piston into rotational motion of the output shaft.

6. The engine of claim 5, wherein the cooperation between the output shaft and the first piston is reciprocal, and enables the rotational motion of the output shaft to be converted into motion of the first piston.

7. The engine of claim 6, further comprising a first guide path integral with the output shaft and a first guiding element integral with the first piston, said first guiding element being mounted so as to move along the first guide path, in order to convert the motion of the first piston into rotational motion of the output shaft.

8. The engine of claim 1, wherein the first piston and the second piston work in opposition in the cylinder.

9. The engine of claim 1, wherein the first piston and the second piston are designed to move so as to undergo opposed reciprocating motions.

10. The engine of claim 1, further comprising an output shaft mounted coaxially with the first piston, the output shaft and the first piston cooperating to convert the motion of the first piston into rotational motion of the output shaft.

11. The engine of claim 10, wherein the cooperation between the output shaft and the first piston is reciprocal, and enables the rotational motion of the output shaft to be converted into motion of the first piston.

12. The engine of claim 10, further comprising a first guide path integral with the output shaft and a first guiding element integral with the first piston, said first guiding element being mounted so as to move along the first guide path, in order to convert the motion of the first piston into rotational motion of the output shaft.

13. The engine of claim 1, further comprising a first valve mounted on the first piston in order to control the opening and closing of said first passageway.

14. The engine of claim 13, wherein the engine is designed to operate with the following four-stroke cycle:

during a first stroke, the first and second pistons move further apart, which creates a vacuum in the combustion chamber, thereby forcing the working fluid to be sucked in via the second passageway, the second valve being opened to allow the working fluid to enter the combustion chamber, the first valve being itself closed;

once they have arrived at their positions furthest apart, the first piston and the second piston move closer together so as to compress the working fluid contained in the chamber (3), this coming-together movement of the pistons corresponding to the second stroke, the first and second valves being closed so as to compress the working fluid between the pistons;

when the pistons reach their point closest together, the working fluid, when compressed to the maximum, explodes through the ignition effect obtained by producing a spark generated by a spark plug or through the effect of the compression ratio itself, which heats the working fluid such that it explodes spontaneously;

this explosion phase produces an expansion of the gases constituting the working fluid; said expansion generating a high pressure in the chamber which is exerted on the pistons, the valves of which are closed, thereby causing the pistons to move apart;

this moving-apart of the pistons through the effect of the pressure resulting from the explosion in the chamber makes the output shaft rotate;

the pistons then come closer together again, which creates a compression in the chamber; and at this moment, the first valve of the first piston is opened, thereby making it possible, through the compression effect produced by the pistons moving closer together for the burnt working fluid to be exhausted through the first passageway;

after this fourth stroke, the engine is again in the configuration corresponding to the first stroke and is ready, once again, to start the four-stroke cycle.

15. The engine of claim 1, further comprising a second valve mounted on the second piston in order to control the opening and closing of said second passageway.

16. An internal combustion engine comprising:

a chamber designed to receive a working fluid intended to undergo combustion within said chamber;

a first piston and a second piston, both of which contribute to delimiting the volume of said chamber;

a first passageway provided through said first piston in order to bring the inside of the chamber into communication with the outside of the chamber, said first passageway being designed to discharge, out of the chamber, the burnt fluid resulting from the combustion of the working fluid;

a second passageway provided through said second piston in order to bring the inside of the chamber into communication with the outside, said second passageway being designed to supply the chamber with the working fluid;

an output shaft mounted coaxially with the first piston, the output shaft and the first piston cooperating to convert the motion of the first piston into rotational motion of the output shaft; and a first valve mounted on the first piston to control the opening and closing of said first passageway, wherein the output shaft and the first valve cooperate to convert the rotational motion of the output shaft into motion of the first valve relative to the first piston.

17. The engine of claim 16, further comprising a second guide path integral with the output shaft and a second guiding element integral with the first valve, said second guiding element being mounted so as to move along the second guide path, in order to convert the rotational motion of the output shaft into motion of the first valve relative to the first piston.

18. The engine of claim 17, wherein the position of the second guide path relative to the output shaft can be translationally and/or rotationally adjusted.

* * * * *